United States Patent [19]

Cunningham

[11] Patent Number: 5,004,957

[45] Date of Patent: Apr. 2, 1991

[54] DIMMING CONTROL CIRCUIT

[75] Inventor: David W. Cunningham, Los Angeles, Calif.

[73] Assignee: Lee Colortran, Inc., Burbank, Calif.

[21] Appl. No.: 294,378

[22] Filed: Jan. 6, 1989

[51] Int. Cl.[5] ..... H05B 37/02

[52] U.S. Cl. ..... 315/199; 315/208; 315/291; 315/DIG. 4

[58] Field of Search ..... 315/194, 199, 208, 291, 315/DIG. 4

[56] References Cited

U.S. PATENT DOCUMENTS 3,821,601 6/1974 Kappenhagen .
3,875,458 4/1975 Kappenhagen .
3,927,349 12/1975 Suhren et al. .
4,096,414 6/1978 Howell .
4,219,761 8/1980 Mustoe .
4,523,131 6/1985 Zansky .
4,651,060 3/1987 Clark ..... 315/199

*Primary Examiner*—Robert J. Pascal
*Attorney, Agent, or Firm*—Christie, Parker & Hale

[57] ABSTRACT

A circuit and a method for controlling the dimming of incandescent lights using a pair of antiparallel connected SCRs which are fired at the same frequency as the frequency of the AC line power to achieve phase control of the power supplied to the light. Only one SCR of the pair is utilized in the 0% to 50% brightness range while both SCRs are utilized in the 51% to 100% brightness range.

18 Claims, 3 Drawing Sheets

8
17
OPTOISOLATOR
A
B
30
60 Hz
PHASE CONTROL
GENERATOR
R3
R1
R2
19
20
22
24
26
28
16
18
21
INCANDESCENT
LAMPS
AC
NEUTRAL
14
12
10
A.C.
120 VOLTS

DIMMER POWER OUTPUT LEVEL LIGHTING INTENSITY %
CIRCUIT
0
25
50
75
100
CONVENTIONAL 120 Hz PHASE CONTROL GENERATOR OUTPUT
9
11
13
15
23
POWER OUTPUT CONVENTIONAL 120 Hz DIMMER
25
27
35
29
37
31
39
33

60 Hz PHASE CONTROL SEE Ⓐ FIG. 1 AT GENERATOR OUTPUT
32
34
36
38
40
POWER OUTPUT SEE Ⓑ FIG. 1 AT 60 Hz DIMMER CIRCUIT OUTPUT
42
44
46
48
50
52
54
56

DIMMING CONTROL CIRCUIT

BACKGROUND OF THE INVENTION

1. Field of the Invention

This invention relates to lamp dimming circuits and, more particularly, to dimming circuits that control the brightness of lighting equipment while reducing acoustic noise generated by the equipment.

2. Description of the Prior Art

Control of lighting intensity is desirable in many applications, including theater, sound stage, television lighting and architectural applications. In such applications it is quite common for there to be a plurality of lamps at different locations and, in many instances, banks of such lamps in specified positions. Typically, a plurality of modules each comprising dimming circuits are utilized to achieve gradations of light intensity in each grouping of lighting equipment and thereby obtain special lighting effects.

Dimming control systems in the past have utilized silicon controlled rectifiers (SCR), for example, solid state AC relays utilizing antiparallel connected SCR's to achieve dimming control. Such prior art control circuits have operated on the principal of operating at firing intervals that are a multiple of the line frequency typically 120 Hz to thereby achieve control of the power supplied to the incandescent lamps by controlling the portion of each cycle of the power source that is delivered to the load (phase control). Using phase control, only a fraction of the power available during each cycle is supplied to the incandescent lamps to thereby achieve the ability to dim the output to any level from no dimming (100% light output) to 100% dimming (no light output).

Such dimming control circuits are operable and acceptable for the reason that the human eye integrates the flicker in light intensity and does not detect the rapid "on/off" operation of the lamps when operated at less than full brightness. Prior art SCR control circuits have been characterized by the use of an inductor in series circuit relationship between the source of electric power and the solid state relay. Such circuits, however, have also been characterized by a relatively high amount of acoustic output from the filaments of the lighting devices during their operation. At a minimum such acoustic noise is annoying, particularly to those in the vicinity of the lamps and, in some instances, particularly in stage and television lighting situations, the noise is of a sufficient intensity as to be unacceptable. In addition, because of the size of the inductance required, such circuits have also been characterized by substantial weight, size and bulk.

It is a feature of the present invention that the dimming control circuit according to the invention achieves substantial reduction in the acoustic output of the lighting devices, particularly in the lower ranges of light intensity output, and a physical arrangement that is smaller and lighter in size.

SUMMARY OF THE INVENTION

The present invention provides a dimming circuit for controlling lighting devices which includes a pair of SCR's connected in antiparallel circuit relation, each SCR having a control electrode. A phase control signal generator is connected to the control electrode of each SCR for switching the SCR on and off. A source of electric power is connected to the input to the dimming circuit by inductive means connected in series circuit relationship between the source of power and the input electrodes of the antiparallel connected SCR's. Means are provided for controlling the output of the signal generator such that the one or both of the SCR's are turned on and off by means of pulses from the generator operating at line frequency and a predetermined pulse duration to thereby control the intensity of lighting provided by the lighting devices and to suppress the acoustic noise generated by the lighting devices.

The present invention differs from conventional dimming circuits by firing the SCR's at 60 Hz (the frequency of conventional AC line power) rather than 120 Hz. As a result, there is a significant reduction in the acoustic noise generated by filaments of, for example, the incandescent lamps, particularly when they are operated in a 0 to 50% brightness range. In addition, in comparison to conventional dimming circuits, the electromagnetic interference (EMI) and the radio frequency interference (RFI) which is generated by the incandescent lamps when controlled by the dimming circuit according to the present invention is also proportionally reduced due to a reduction in the amount of chopping of the sine wave of the power signal from the AC line source of power.

By operating the dimming circuit of the present invention by firing the SCR's at 60 Hz rather than 120 Hz, a number of significant improvements in dimmer circuit design can be achieved. In one instance, dimmer circuit acoustic performance can be achieved which is equal to or superior to conventional circuit performance while using a substantially lower rated, smaller and lighter inductor, one which is on the order of 60% of that which is used in a conventional prior art dimming circuit. On the other hand, by operating a conventional dimming circuit with a conventional or typical prior art inductor at 60 Hz, very substantial improvement in acoustic performance, i.e., noise reduction, is obtained.

Thus, operation of a dimming circuit at 60 Hz enables the circuit designer to select among a number of parameters to achieve an optimum result. Reduction in inductance size provides a smaller, lighter and more compact package while achieving acoustic noise suppression which is at least equal to a 120 Hz operation using a conventional size inductance. Retention of a conventional size inductance in a circuit operated at 60 Hz provides substantially higher noise suppression and, at the same time, also results in significantly less heat being generated by the dimming circuitry. A reduction in the amount of heat generated means a substantial reduction in the amount of cooling and air conditioning equipment needed in conjunction with the dimming circuitry.

DESCRIPTION OF THE DRAWINGS

In order to better understand the above-described features and advantages of the invention as well as others which will become apparent in the detailed description, the following drawings are provided, wherein.

DESCRIPTION OF THE PREFERRED EMBODIMENT

Figure 1:
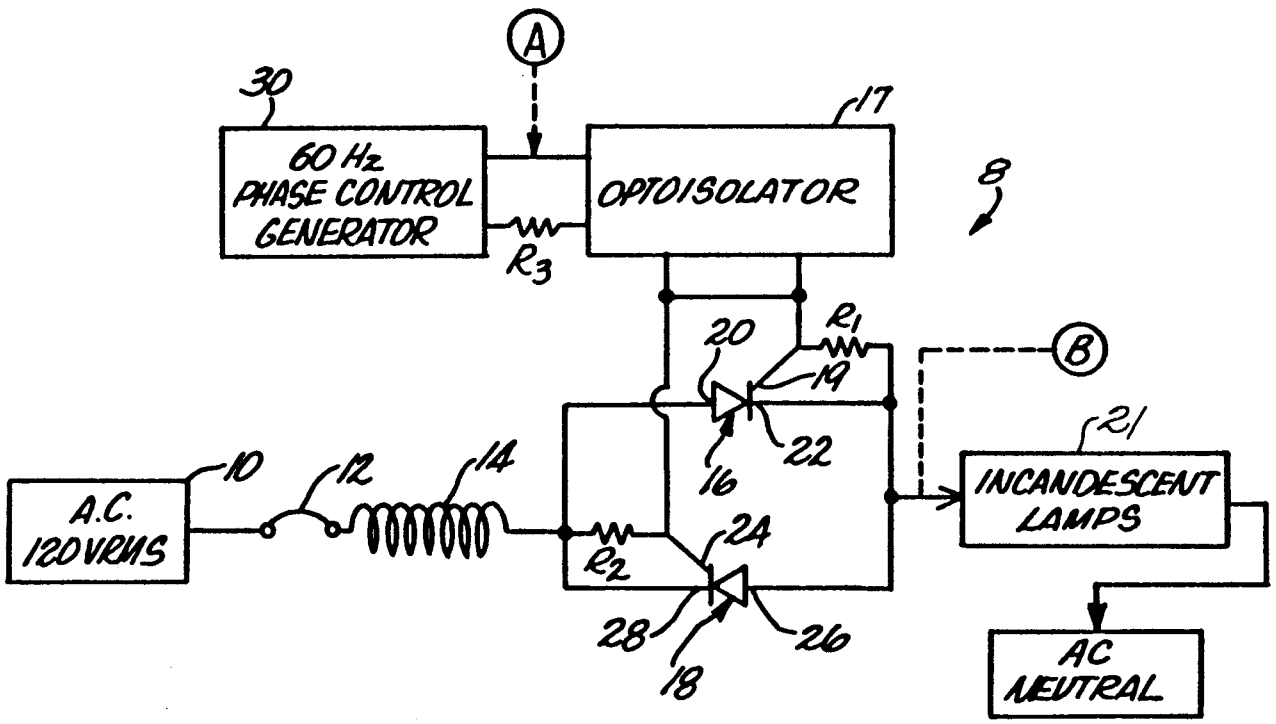
FIG. 1 is a schematic diagram of a preferred embodiment of the present invention.

As shown in FIG. 1, the dimming circuit 8 of the present invention comprises a source of conventional, 60 Hz, 120 volt, AC power 10 for providing the power to lighting devices such as incandescent lamps with which the dimming circuit of the present invention is used. The circuit is a series circuit arrangement and, in the presently preferred embodiment, a power source 10 is connected through circuit breaker 12 to inductor 14. Inductor 14 is in turn connected to a pair of silicon controlled rectifiers (SCR) 16, 18, connected in an anti-parallel circuit relation SCR 16 includes a gate electrode 19, an anode electrode 20, and a cathode electrode 22. SCR 18 includes a gate electrode 24, an anode electrode 26, and a cathode electrode 28. Cathode electrode 28 is electrically connected to anode electrode 20. Cathode electrode 22 and anode electrode 26 are likewise connected in electrical circuit relationship, and the common circuit connection of these two electrodes forms the output of the dimming circuit which is connected to an electric incandescent lamp load 21. Electrodes 19 and 24 are control electrodes for turning the SCR on and off when a trigger signal or pulse is transmitted to the control electrode.

A phase control signal generator 30 has its output connected to gate electrodes 19, 24 of SCR's 16 and 18 through an opto-isolator 17. The output of generator 30 controls the firing of SCR's 16 and 18. By providing a 60 Hz output from generator 30 rather than some higher multiple of line frequency, SCR 16 and SCR 18 are fired, i.e., turned on and off, not more than once during each complete cycle of a conventional AC line.

To control dimming of the lamp load, the output of the signal generator 30 is controlled. In the presently preferred embodiment, a control module (not shown) is operated to select a pulse duration (pulse width) from generator 30 that controls the phase angle of the line power and corresponds to the amount of power to be delivered to the lighting devices. The greater the pulse duration, the more power that is delivered to the lighting devices and the higher the intensity of light produced by the devices. A single pulse is generated during each full cycle of the power source by control generator 30 with the width of the pulse varying in accordance with the amount of dimming selected. The width of the pulse output from the signal generator 30 is narrow during high dimming requirements and wider during low dimming requirements. The width of the pulse controls the period during which the SCR is turned on and thereby controls the phase angle and the amount of electrical energy that is transmitted from the power source to the lamp load.

Figures 2A, 2B:
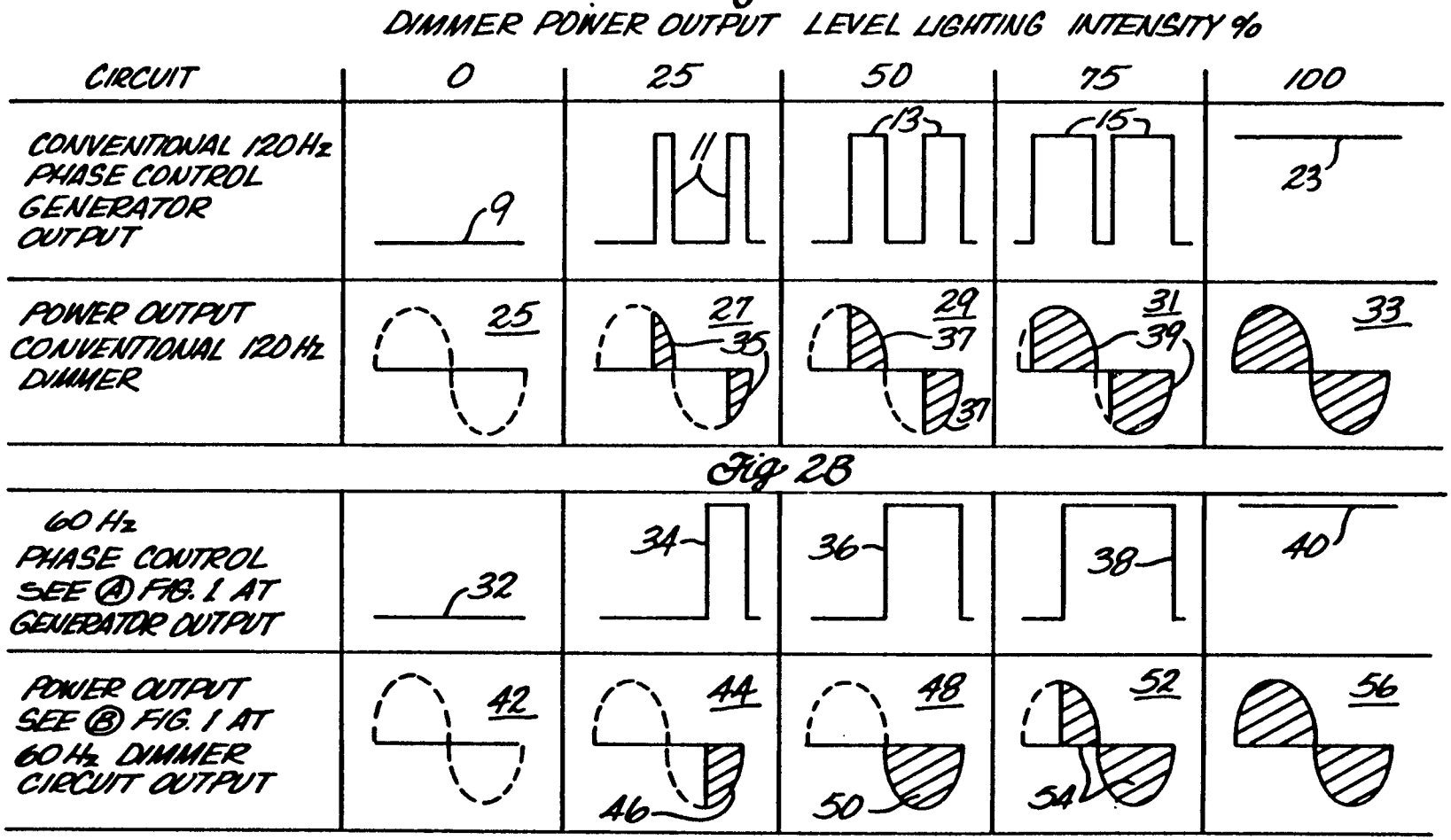
FIG. 2A is a waveform diagram depicting the power output waveform of a conventional dimming circuit.
FIG. 2B is a waveform diagram depicting the power output waveform of a dimming circuit according to the present invention.

The foregoing can be better seen by reference to the waveform diagrams in FIGS. 2A and 2B. In FIG. 2A, the output waveform from a conventional 120 Hz phase control signal generator is shown. A light output level of zero light, i.e., maximum dimming is shown at 9. At this setting there is no output from the signal generator. At an output load of 25% brightness, two pulses 11 are generated for each full cycle of line power with a pulse width of the signal generator as shown. At an output load of 50% brightness, the width of the two output pulses 13 from the signal generator are as shown. At this setting, the width of each pulse is approximately equal to the width of each half cycle of the line voltage. At 75% output, the pulses 15 are of the width as shown, and, at 100% output, the output from the generator is shown at 23. As shown, the output from the signal generator is steady, not pulsing.

The waveform of the power delivered to the lighting devices controlled by a conventional 120 Hz dimming circuit is shown below the pulse forms of the phase control generator in FIG. 2A.

The waveform at 25 corresponds to zero output from the lamps, that is, maximum dimming, and, as shown by waveform 25, no power is delivered to the incandescent lamps. The waveform at a 25% output level is shown at 27, and as shown therein, under the phase control of the signal generator, the power in one-quarter of each half cycle as shown at shaded portion 35 is delivered to the lamps. At a 50% level of output power, the waveform is shown at 29 and the amount of power delivered is shown at 37, equal to one half of each half cycle. At 75% output, the waveform is shown at 31, and, as indicated by the cross hatching (shading) at 39, the amount of power delivered to the lamps is shown. At 100% output level from the lamps, 100% of the power in each cycle is delivered to the incandescent lamps as shown at 56.

In FIG. 2B, the output waveform from the phase control signal generator is shown. A light output level of zero light, i.e., maximum dimming is shown at 32. At this setting there is no output from the signal generator. At an output load of 25% brightness, the pulse width of the signal generator is shown at 34. At an output load of 50% brightness, the width of the output pulse from the signal generator is shown at 36. At this setting, the width of the pulse is approximately equal to the width of a half cycle of the line voltage. At 75% output, the waveform is seen at 38, and, at 100% output, the pulse from the generator is shown at 40, the output from the signal generator is steady, not pulsing.

The waveform of the power delivered to the lighting devices controlled by the dimming circuit according to the present invention is shown below the pulse forms of the phase control generator in FIG. 2B.

The waveform at 42 corresponds to zero output from the lamps, that is, maximum dimming, and, as shown by waveform 42, no power is delivered to the incandescent lamps. The waveform at a 25% output level is shown at 44, and as shown therein, under the phase control of the signal generator, the power in one-quarter of a cycle as shown at shaded portion 46 is delivered to the lamps. At a 50% level of output power, the waveform is shown at 48 and the amount of power delivered is shown at 50, equal to half a cycle. At 75% output, the waveform is shown at 52, and, as indicated by the cross hatching at 54, the amount of power delivered to the lamps is shown. At 100% output level from the lamps, 100% of the power in each cycle is delivered to the incandescent lamps as shown at 56.

As indicated previously, the dimming circuit of the present invention achieves substantial reduction in the amount of acoustic noise generated by the filaments of a lamp or the lamps in a grouping or bank of lights to which the dimming circuit is connected. For the phase controlled AC power signal provided by the circuit of FIG. 1, the reduction in acoustic noise is primarily achieved when the lamps are operated in the 0% to 50% power output levels. Such noise reductions are highly desirable, both in theatrical/television lighting and in architectural fixtures applications.

In addition, as indicated, the inductor which is used with the dimming circuit of present invention is, in one specific embodiment, reduced 40% in size, weight and inductance compared to the prior art and, at the same time, a significant reduction is realized in the amount of electromagnetic interference (EMI) and radio frequency interference (RFI) generated by the present dimming circuit in comparison to prior art circuits.

In the presently preferred embodiment of the invention, control of the dimmer circuit is achieved by use of a microprocessor in the control module. The firing rate of the SCR's of the dimmer circuit is controlled and thereby the desired output power from the dimming circuit and the brightness obtained from the incandescent lamps is achieved. The desired brightness output is transmitted to the microprocessor, and the microprocessor in turn controls the signal generator and the width and frequency of the output pulses from the signal generator.

In the presently preferred embodiment, the phase control signal generator is connected to the gate electrode of each SCR through an opto-isolator. The opto-isolator isolates the dimming current and the user from the high voltage side of the line.

Figure 3A:
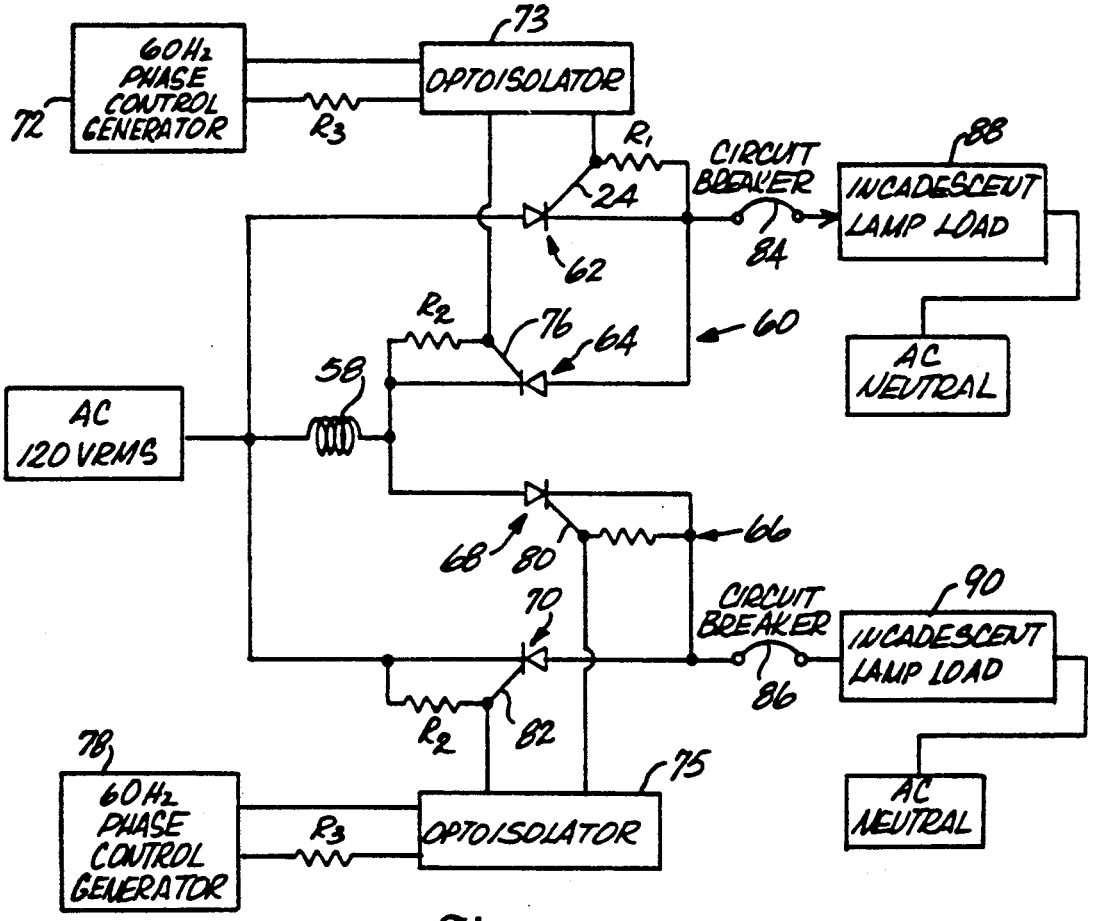
FIG. 3A is a schematic diagram of an alternate embodiment of the circuit of the present invention using a single inductor common to two dimming circuits.

The circuit shown in FIG. 3A illustrates an alternate embodiment of the circuit of the present invention. In this embodiment, the circuit comprises a pair of antiparallel SCR circuits 60, 66 connected in parallel circuit relationship with an inductor 58 connected in common to the input side of the pair of SCR circuits.

As shown in FIG. 3A, inductor 58 is connected to SCR 64 of SCR circuit 60 which consists of SCR 62 connected in antiparallel relation to SCR 64 and to SCR 68 of SCR circuit 66 which consists of SCR 68 connected in antiparallel relation to SCR 70. A 60 Hz phase control signal generator 72 is connected through an opto-isolator 73 to the gate electrodes 74, 76 of the SCR's of circuit 60 and, similarly, a 60 Hz phase control generator 78 is connected through an opto-isolator 75 to the gate electrodes 80, 82 of the SCR's of circuit 66. The output from each circuit 60, 66 is connected through circuit breakers 84, 86 to their respective loads 88, 90.

In operation, SCR circuit 60, for example, is phase fired and SCR 64 operates, chopping the negative half cycle of the sine wave of the input power signal while SCR 62 acts as a switch which is either on or off. Current flow during this half cycle is through inductor 58 to SCR 64 and thereafter through circuit breaker 84 to lamp load 88. Since SCR 62 is either on or off, no chopping of the sine wave of the input power signal from SCR 62 is produced and no filtering is required. This reduces the average current in inductor 58 by 50%.

During the positive half of the cycle of power signal, circuit 66 operates in a manner similar to circuit 60. In this instance, SCR 68 is operated chopping the positive half cycle of the sine wave of the input power signal while SCR 70 acts as a switch and no chopping occurs. Current flow during this half cycle is through inductor 58 to SCR 68 and thereafter through circuit breaker 86 to lamp load 90. Since a 50% reduction in the current in the inductor is produced in each half cycle, the average current is the same as for a single SCR antiparallel circuit while enabling the use of an inductor which is substantially smaller and less costly.

Figure 3B:
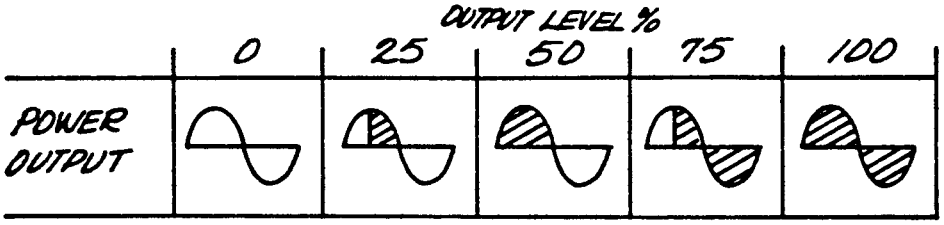
FIG. 3B is a waveform diagram depicting the power output waveform of the circuit of FIG. 3A.

The waveform diagram in FIG. 3B illustrates the waveform of the output power for power output levels of 0% and 100%, that is, full dimming to full brightness. Intermediate those extremes, the waveforms for the power output levels for 25% of total power, 50% of total power and 75% of total power are also shown. For the 25% power output level, the phase angle is one half of the positive half cycle. At 50% power, the phase angle is the full width of the positive half cycle. At 75% power, the phase angle is the width of the negative half cycle plus one half of the positive half cycle. At 100% power, the phase angle is the full width of the entire cycle.

What is claimed is:

1. A dimming circuit for lighting devices comprising:

a pair of silicon controlled rectifiers (SCR) connected in parallel opposed circuit relation, each SCR having a control electrode, a phase control signal generator connected to the control electrode of each SCR for switching the SCR on and off, a source of electric power connected to the input to the dimming circuit, inductive means connected in series circuit relationship with the source of power and the pair of SCR's, and means for controlling the signal generator such that one or both of the SCR's are turned on and off by means of pulses from the generator having a frequency of approximately 50–60 Hz and a predetermined pulse duration to control the intensity of the light provided by the lighting devices and to suppress the acoustic noise generated by the lighting devices.

2. A circuit according to claim 1 wherein the inductive means is an inductor.

3. A circuit according to claim 2 wherein the inductor is a toroidal choke.

4. A circuit according to claim 2 wherein the pulse frequency from the generator is 60 Hz.

5. A circuit according to claim 2 wherein the pulse frequency from the generator is 50 Hz.

6. A circuit according to claim 4 wherein only one SCR of the pair is turned on for a predetermined period of time when the dimming circuit is operated in the range of lighting intensity between 0 to 50% brightness.

7. A circuit according to claim 4 wherein one SCR of the pair is turned on throughout an entire half cycle and the other SCR for a predetermined portion of the other half cycle when the dimming circuit is operated in the range of lighting intensity between 50% and 100% brightness.

8. A circuit according to claim 6 wherein an opto-isolator is coupled in series circuit relationship between the signal generator and the pair of SCR's.

9. A circuit according to claim 7 wherein the lighting devices are incandescent lamps.

10. A dimming circuit for lighting devices comprising:

at least two parallel silicon controlled rectifiers (SCR) connected in parallel circuit relationship, each SCR having a control electrode, a phase control signal generator connected to the control electrode of each SCR for switching each SCR on and off, a source of electric power connected to the input to the dimming circuit, said power source having at least two phases, each phase being connected to a respective one of said SCR's, inductive means connected in series circuit relationship with the parallel SCR's between the source of power and the load of lighting devices, and means for controlling the signal generator such that one or more of the SCR's are turned on and off by means of pulses from the generator having a frequency of approximately 50–60 Hz and a predetermined pulse duration to control lighting intensity and suppress acoustic noise generated by the lighting devices.

11. A dimming circuit for lighting devices comprising:

a first pair of silicon controlled rectifiers (SCR) connected in parallel opposed circuit relationship, each SCR having a control electrode, a source of AC electric power connected to the input to the dimming circuit for providing power to the lighting devices, a second pair of SCR's connected in parallel opposed circuit relationship, each SCR having a control electrode, said second pair being connected in parallel circuit relationship with said first pair, a first phase control signal generator connected to the control electrode of each SCR of the first pair for switching one of the SCR's on and off while holding the other SCR either on or off during the positive going portion of each cycle from the power source, a second phase control signal generator connected to the control electrode of each SCR of the second pair for switching one of the SCR's on and off while holding the other SCR either on or off during the negative going portion of each cycle from the power source, inductive means connected in series circuit relationship with the source of power and a predetermined one of the SCR's in each of the first and second pair, and means for controlling the signal generator such that the switchable SCR in the first and second pair is turned on and off by means of pulses from the generator having a frequency of approximately 60 Hz and a predetermined pulse duration to control the intensity of the light provided by the lighting devices and to suppress the acoustic noise generated by them.

12. A method of operating a dimming circuit for electric lamps comprising the steps of:

(1) supplying electric power to a signal generator, (2) connecting a source of electric power to be transmitted to the incandescent lamps, through a series circuit interconnection of a noise control inductor and a pair of SCR's connected in antiparallel circuit relationship, each SCR having a control electrode, (3) connecting the lamps to the output side of the series circuit combination of inductor and SCR pair and the signal generator to the control electrodes of said SCR pair, (4) controlling the amount of power to be delivered to the lamps by selectively operating the signal generator, and (5) causing one or both of the SCR pair in response to the signal generator to be selectively turned on and off at a frequency of approximately 50–60 Hz each for a predetermined period of time to thereby control the brightness of the lamps and to suppress acoustic noise generated by the lamps.

13. The method of claim 12 including the step of controlling the phase angle of the power supplied the incandescent lamps by means of the signal generator.

14. The method of claim 13 including the step of selecting a pulse of a predetermined pulse width to control the phase angle of the power to the lamps and thereby control the brightness of the lamps.

15. The method of claim 14 including the step of transmitting the preselected pulse to each control electrode of the SCR's.

16. The method of claim 15 including the step of operating the dimming circuit in the 0% to 50% output power range to maximize noise suppression by limiting the pulse width so as to operate only one SCR for a predetermined period of time.

17. The method of claim 15 including the step of operating the dimming circuit in the 51% to 100% output power range by increasing the pulse width so as to operate one SCR for a first predetermined period of time and the second SCR for a second predetermined period of time.

18. The method of claim 15 wherein one or both of the SCR pair are turned on and off at a frequency of 60 Hz.

* * * * *

UNITED STATES PATENT AND TRADEMARK OFFICE

CERTIFICATE OF CORRECTION

PATENT NO. : 5,004,957

DATED : April 2, 1991

INVENTOR(S) : David W. Cunningham

It is certified that error appears in the above-identified patent and that said Letters Patent is hereby corrected as shown below:

Title Page:

[56] References Cited, U.S. PATENT DOCUMENTS, please add the following references:

| | | | |
|---|---|---|---|
| -- | 2,783,416 | 6/1953 | Butler |
| | 3,681,654 | 8/1972 | Quinn |
| | 3,943,397 | 3/1976 | Yancey |
| | 3,996,475 | 12/1976 | Rodriguez |
| | 4,057,751 | 11/1977 | Bonsignore et al. |
| | 4,109,231 | 8/1978 | Krouse |
| | 4,238,723 | 12/1980 | Jenks |
| | 4,311,956 | 1/1982 | Tolmie, Jr. |
| | 4,395,660 | 7/1983 | Waszkiewicz |
| | 4,568,858 | 2/1986 | Matsui |
| | 4,769,557 | 9/1988 | Houf et al. |
| | 4,823,069 | 4/1989 | Callahan -- |

OTHER PUBLICATIONS, please insert -- Copyright March 1985 Colortran, Inc. - 192 Pack - 1 page from brochure entitled Colortran, Inc.

Abstract, line 5, change "light" to -- lights --.

UNITED STATES PATENT AND TRADEMARK OFFICE

CERTIFICATE OF CORRECTION

PATENT NO. : 5,004,957

DATED : April 2, 1991

INVENTOR(S) : David W. Cunningham

It is certified that error appears in the above-identified patent and that said Letters Patent is hereby corrected as shown below:

Column 3, line 19, after "relation" insert a period.

Signed and Sealed this

Fifth Day of January, 1993

*Attest:*

DOUGLAS B. COMER

*Attesting Officer*

*Acting Commissioner of Patents and Trademarks*